US006280373B1

(12) United States Patent
Lanvin

(10) Patent No.: US 6,280,373 B1
(45) **Date of Patent: *Aug. 28, 2001**

(54) CUTTING TOOL SUPPORT

(75) Inventor: Serge Lanvin, Cire les Mello (FR)

(73) Assignee: Heidelberger Druckmaschinen, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,475

(22) Filed: Sep. 2, 1998

(30) Foreign Application Priority Data

Sep. 2, 1997 (FR) ..... 97 10892

(51) Int. Cl.[7] ..... B31B 1/14

(52) U.S. Cl. ..... 493/227; 493/194; 83/698.41; 83/343

(58) Field of Search ..... 83/698.41, 139, 83/343, 345; 493/194, 199, 223, 359, 227

(56) References Cited

U.S. PATENT DOCUMENTS 3,277,756 * 10/1966 Jardins et al. ..... 83/698.41
4,784,031 * 11/1988 Dixon ..... 83/139
4,862,778 9/1989 Dixon .

FOREIGN PATENT DOCUMENTS 44 24 919 C1 9/1995 (DE) .

* cited by examiner

*Primary Examiner*—Peter Vo
*Assistant Examiner*—Louis K. Huynh
(74) *Attorney, Agent, or Firm*—Herbert L. Lerner; Laurence A. Greenberg; Werner H. Stemer

(57) ABSTRACT

In a device for cutting a web of material in a folder having a cutting tool accommodated on a cutting cylinder, there is provided a cutting tool support which includes pressure bars of elastic material flanking and directly engaging the cutting tool, and projecting resiliently beyond a jacket of the cutting cylinder, the pressure bars being formed of an elastic base material and a contact material having a greater hardness than that of the base material, the base material of the pressure bars being in engagement with the web of material during the cutting of the web of material.

13 Claims, 3 Drawing Sheets

CUTTING TOOL SUPPORT

BACKGROUND OF THE INVENTION

Field of the Invention:

The invention relates to a cutting tool support, especially on a rotating cylinder in rotary printing presses, and more particularly to a device for cutting a web of material in a folder, particularly, of rotary printing presses, the cutting device having a cutting tool, such as a knife, accommodated on a cutting cylinder, and pressure bars of elastic material flanking the cutting tool or knife with which the pressure bars are in immediate contact, the pressure bars projecting resiliently beyond or past a jacket of the cutting cylinder.

German Patent 1 611 282 relates to a device for cutting a paper web in a folder. A cutting knife is secured between clamping bars in a knife cylinder formed with a longitudinal groove. The cutting knife is flanked on both sides thereof by resilient pressure bars of soft elastic plastic material which directly contact the cutting knife and project beyond the jacket of the knife cylinder. The pressure bars have a radially outwardly extending taper in the region of the length thereof projecting beyond the jacket of the knife cylinder, and impart a given elastic resilience in the circumferential direction to the cutting knife.

The published German Patent Document DE 44 24 919 C1 is concerned with a cutting knife bar of a cutting cylinder in folding units of web-fed rotary printing presses. To support a cutting knife in a vibration-damping manner and to avoid damage to a product or copy, contact-pressure strips or bars of synthetic rubber with a fine cellular structure are used.

The published German Patent Document DE 42 44 786 A1 is concerned with a device for adjusting a cutting knife bar or strip for a cutting cylinder in a rotary printing press. In this adjusting device, there is provided a device for displacing cutting knife strips or bars on a cutting cylinder for cutting a length of paper web crosswise both for collect-run and noncollect-run production which should be of compact construction and simple to operate. This is achieved by providing the cutting knife strips or bars, on a bottom surface thereof, with circular slits in an acute angle, with stay bolts engaging in the slits and, in turn, being movable by a drive in axial direction, so that the cutting knife strips or bars are capable of moving circumferentially on the cutting cylinder.

In high-speed folders, multilayer lengths of paper web entering between the pair of cutting cylinders exert major forces on the cutting tool support. The half of the cutting knife support oriented towards the web of material is especially severely stressed. Due to the high stress and the elasticity of the pressure bars, premature fatigue can occur thereat, which becomes apparent by the development of cracks in the material of which the pressure bars are formed. This impairs the support of the cutting tool on both sides thereof.

SUMMARY OF THE INVENTION

It is accordingly an object of the invention to provide a cutting tool support of such construction that it optimally supports the cutting tool without being vulnerable to material fatigue.

With the foregoing and other objects in view, there is provided, in accordance with one aspect of the invention, in a device for cutting a web of material in a folder having a cutting tool accommodated on a cutting cylinder, a cutting tool support which includes pressure bars of elastic material flanking and directly engaging the cutting tool, and projecting resiliently beyond a jacket of the cutting cylinder, the pressure bars being formed of an elastic base material and a contact material having a greater hardness than hat of the base material, the base material of the pressure bars being in engagement with the web of material during the cutting of the web of material.

In accordance with another feature of the invention, the pressure bars are embedded in a vise embracing the pressure bars.

In accordance with a further feature of the invention, the vise includes two vise halves.

In accordance with an added feature of the invention, the vise has clamping surfaces for acting upon the pressure bars.

In accordance with an additional feature of the invention, the vise halves are formed with clamping surfaces between which the cutting tool is received.

In accordance with yet another feature of the invention, the base material of the pressure bars has a Shore hardness between 30 and 35 Shore.

In accordance with yet a further feature of the invention, the contact material has a Shore hardness greater than 85 Shore.

In accordance with yet an added feature of the invention, the contact material is disposed in a region of the pressure bars that projects beyond the vise.

In accordance with yet an additional feature of the invention, the cutting tool has a tip and is formed with a taper in a region of the cutting tool tip.

In accordance with still another feature of the invention, the pressure bars surround the cutting tool and are spaced from the tapered cutting tool tip, so that the tapered cutting tool tip does not engage the surrounding pressure bars.

In accordance with still a further feature of the invention, the cutting tool is a cutting knife.

In accordance with another aspect of the invention, there is provided, in a folder, a combination comprising a cutting cylinder having a cutting knife disposed thereon for cutting a material web, and pressure bars formed of elastic material flanking and directly engaging the cutting knife and projecting resiliently beyond a jacket of the cutting cylinder, the pressure bars surrounding the cutting knife and being formed of elastic base material and a contact material having a hardness greater than that of the base material, the elastic base material being in engagement with the material web during the cutting thereof.

In accordance with a concomitant aspect of the invention, there is provided a folder having a device for cutting a material web, and comprising a cutting cylinder, a cutting knife disposed on the cutting cylinder, and pressure bars of elastic material flanking and directly engaging the cutting knife, the pressure bars projecting resiliently beyond a jacket of the cutting cylinder, the pressure bars surrounding the cutting knife being formed of an elastic base material and a contact material, the contact material having a hardness greater than that of the base material, the elastic base material being in engagement with the material web during the cutting thereof.

Other features which are considered as characteristic for the invention are set forth in the appended claims.

Although the invention is illustrated and described herein as embodied in a cutting tool support, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
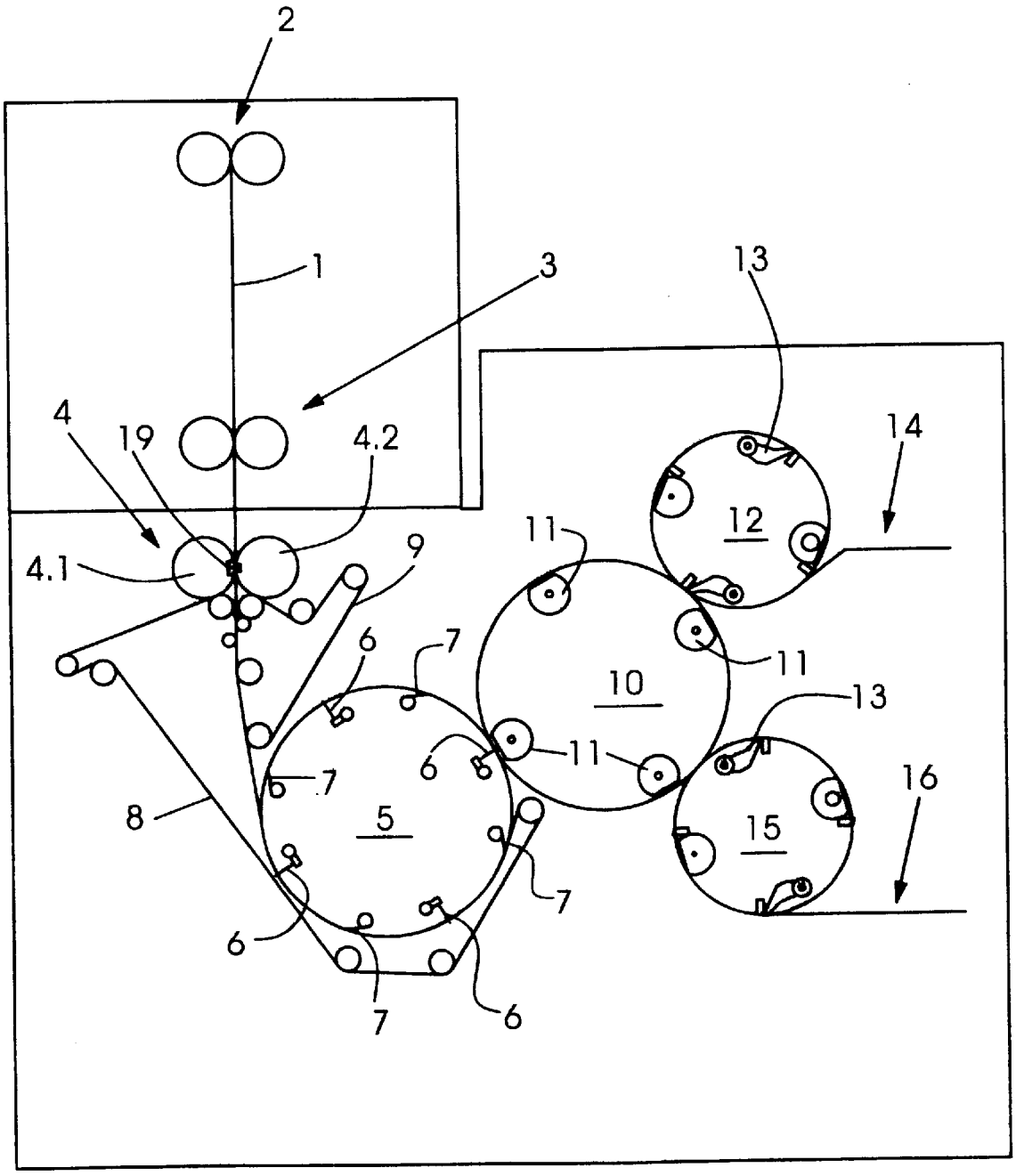
FIG. 1 is a diagrammatic side elevational view of a pin-free folder with a folding knife cylinder and lengths of tapes assigned to the folding knife cylinder.

Referring now to the drawings and, first, particularly to FIG. 1 thereof, there is shown therein a pin-free folder with lengths of tape partly wrapped around a folding cylinder 5 for transporting copies.

A material web 1, formed of one or more web lengths, which are inverted and joined together in a non-illustrated superstructure of the folder, run via first and second tension roller pairs 2 and 3, respectively, into a nip between cylinders 4.1 and 4.2 of a cutting cylinder pair 4. The material web 1 may, but need not necessarily, be longitudinally folded before entering the respective nips of the first and second tension roller pairs 2 and 3, respectively.

The cylinders 4.1 and 4.2 of the cylinder pair 4 are a knife cylinder and a grooved cylinder, respectively, cooperating with one another. In the exemplary embodiment shown, the aforementioned two cylinders 4.1 and 4.2, respectively, are constructed with like so-called single diameters so that one revolution of the respective cylinders 4.1 and 4.2 is precisely equivalent to the length of one copy to be cut from a leading or forward region of the material web 1. The cutting cylinder 4.1 is provided with a cutting knife support 19, which is shown in greater detail in FIG. 3. Downstream from the cutting cylinder pair 4, as viewed in a transport direction of a copy through the folder, are a first and a second tape length 8 and 9, respectively, partly surrounding or wrapped around the circumference of a folding knife cylinder 5. With the aid of copy grippers 6, the copies guided by the tape lengths 8 and 9 are accepted or taken over from the folding knife cylinder 5. Disposed on the circumference of the folding knife cylinder 5 are folding knives or tucker blades 7, which push or punch into the copies in order to form a first crossfold or transverse fold in folding jaws 11 of a folding jaw cylinder 10. In the exemplary embodiment shown in FIG. 1, the folding knife cylinder 5 has a diameter which is four times the diameter of the cutting cylinder 4.1 and can thus receive four copies in succession on the circumference thereof.

The crossfolded copies are then, respectively, gripped at the back of the fold by the folding jaws 11 provided on the folding jaw cylinder 10 and, thereafter, taken over by a lower and an upper gripper cylinder 12 and 15, respectively. Grippers 13 are disposed on the circumferences of the gripping cylinders 12 and 15 and remove the copies from the folding jaw cylinder 10 and carry it to an upper and a lower product delivery point, respectively, for delivery via respective upper and lower delivery paths 14 and 16.

Figure 2:
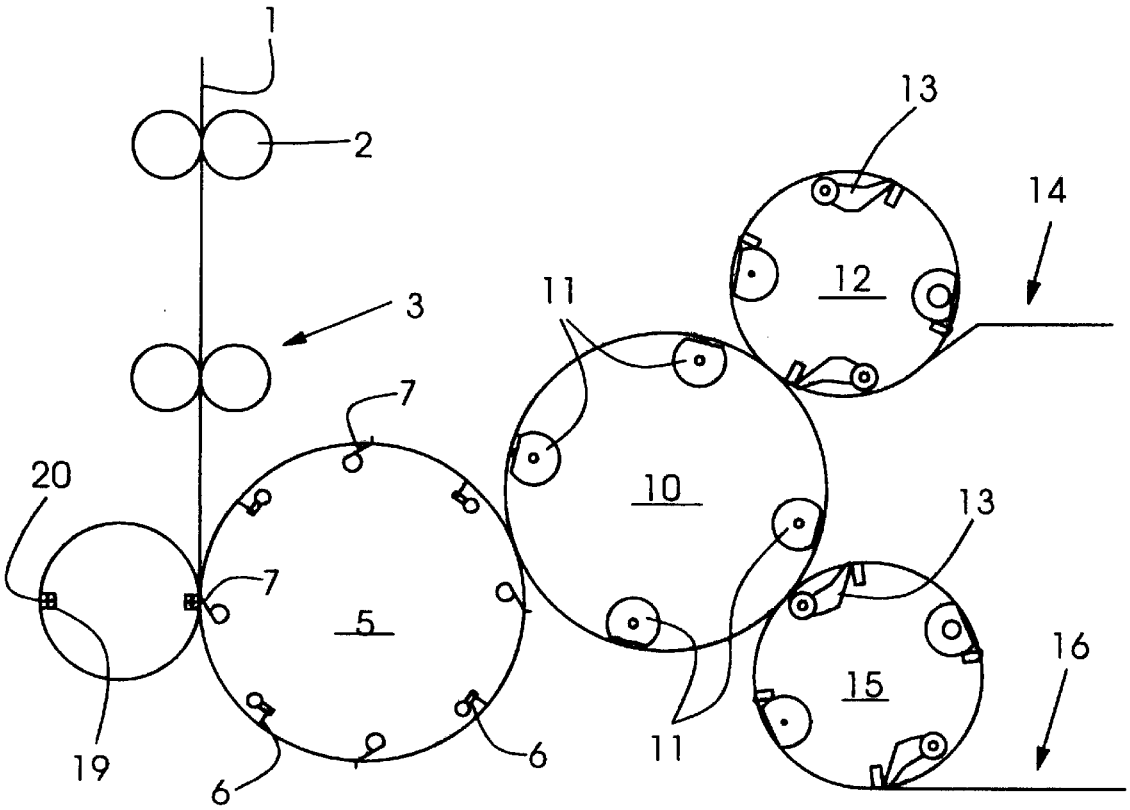
FIG. 2 is a view similar to that of FIG. 1 of a folder with pins and with a cutting cylinder having two cutting tool supports.

In FIG. 2, by comparison, a folder with impaling pins is illustrated. Unlike the pin-free folder of FIG. 1, the folder of FIG. 2 has a folding jaw cylinder 5 provided with impaling pins which impale trailing ends of the copies that have been cut off and temporarily affix them to the circumference of the folding knife cylinder 5. The puncture holes remaining in the copy are a disadvantage, however; nevertheless, the tape lengths 8 and 9 which are assigned to the folding knife cylinder 5 in pin-free folders, such as that of FIG. 1, can be omitted in the folder with pins shown in FIG. 2.

In the exemplary embodiment shown in FIG. 2, a cutting cylinder 17 is assigned to the folding knife cylinder 5. This cutting cylinder 17 is formed with a double diameter, i.e., the lengths of two copies correspond to the circumference thereof, and two cutting knife supports 19 are disposed on the circumference thereof. On the folding knife cylinder 5 shown in FIG. 2, non-illustrated grooved bars are provided which cooperate with cutting knives 20 provided on the cutting cylinder 17.

The other copy-guiding or transporting cylinders, i.e., the folding jaw cylinder 10, the upper gripper cylinder 12 and the lower gripper cylinder 15, correspond to the copy-guiding or transporting cylinders described hereinbefore with regard to FIG. 1, so that further description thereof is believed to be unnecessary.

Figure 3:
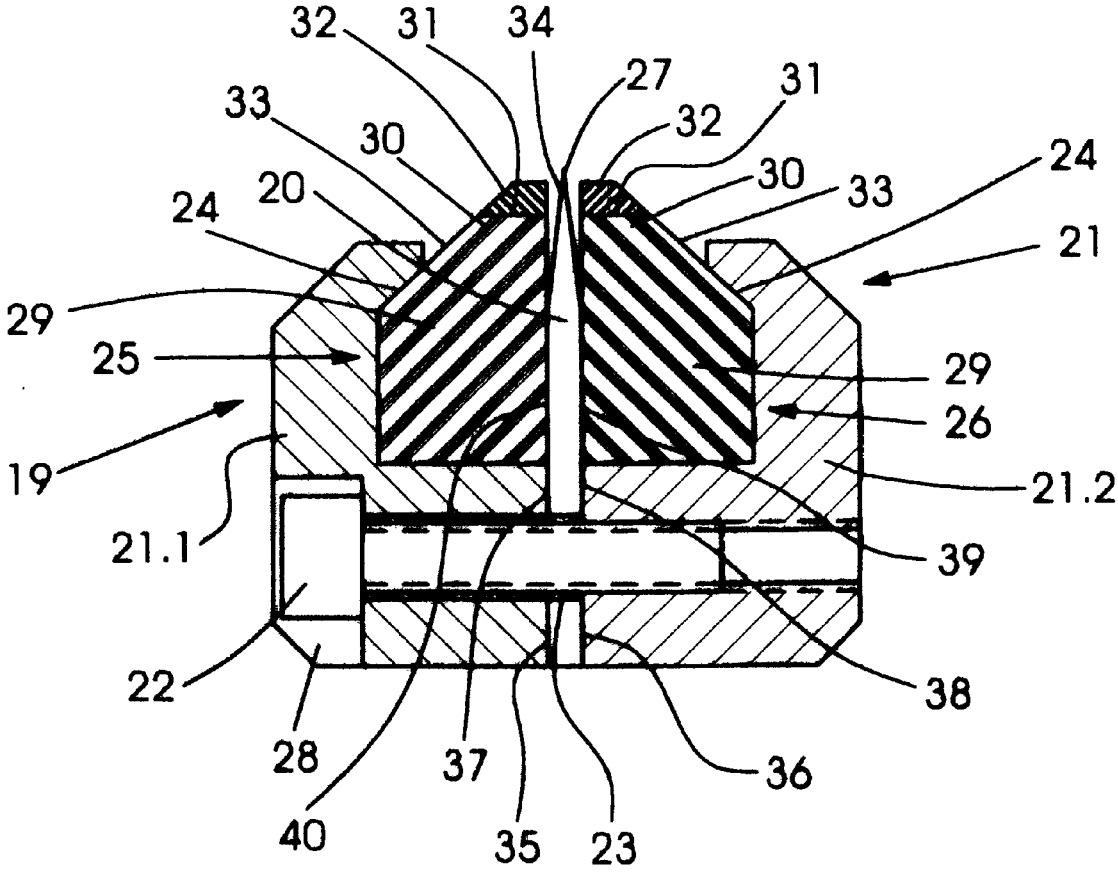
FIG. 3 is a cross-sectional view of a cutting tool support having pressure strips formed of two types of material.

FIG. 3 shows the cutting tool support 19 for a cutting tool. The cutting tool support 19 includes a vise 21 having two halves 21.1 and 21.2 which are joined together by a threaded fastener 22. For better accessibility, the vise half 21.1 shown at the left-hand side of FIG. 3 is formed with a recess 28 in which the head of the threaded fastener 22 is received. The threaded fastener 22 also extends through a bore 23 formed in a cutting tool 20, so that the cutting tool 20 is clamped between the two vise halves 21.1 and 21.2 and at the same time secured against centrifugal force which occurs upon rotation.

For fixing the cutting knife 20 in the cutting tool support 19, the cutting knife 20 is fastened at a lower region thereof in the vise 21, and the lower region of the cutting knife 20 is clamped by clamping surfaces 35 and 37 of the vise half 21.1 at the left-hand side of FIG. 3, and clamping surfaces 36 and 38 of the vise half 21.2 at the right-hand side of FIG. 3. The clamping force is produced by the threaded fastener 22 and causes high rigidity of the cutting knife restraint or fastening in the lower region of the cutting knife 20. The rigidity of the support of the cutting knife 20 decreases toward the cutting knife tip 27. Above the respective clamping surfaces 37 and 38 of the two vise halves 21.1 and 21.2, respective pressure bars or strips 25 and 26 formed of a base material 29 are disposed on both sides of the cutting knife 20. The pressure bars 25 and 26 engage the cutting knife 20 at a middle region thereof. Contact surfaces 39 and 40 of the base material 29 provide a more elastic support of the cutting knife 20 than is provided at the lower region thereof at which the cutting knife 20 is clamped by the clamping surfaces 35, 36, 37 and 38 of the vise halves 21.1 and 21.2.

The pressure bars 25 and 26 at the respective right-hand and left-hand sides of FIG. 3 are formed of a shock-absorbing, elastically deformable material having a Shore hardness of approximately 30 to 35 Shore, and another material 32 which is a contact material. Both pressure bars 25 and 26 of the base material 29 are provided, above a joint or seam surface 31, with the contact material 32 of greater hardness, such as approximately 90 Shore. The contact material 32, such as the material known by the trade name Vulkolan, surrounds the tip 27 of the cutting knife 20 in such a manner that the tip 27 is not engaged by the upper region of the pressure bars 25 and 26. In this regard, the tip 27 of the cutting knife 20 is formed with a taper 34.

The contact material 32, which engages the material web 1 the instant the web 1 enters the cutting nip, is exposed to severe, cyclically occurring stress, upon the rotation of the cutting knife cylinder 4.1 and the grooved cylinder 4.2. The pairing of material according to the invention, that is, the pairing of the elastic material 29 with the contact material 32 having a high Shore hardness, combines high elasticity, on the one hand, with high abrasion resistance, on the other hand, of the pressure bars 25 and 26 in the contact region. The base material 29 lends the requisite elasticity to the pressure bars 25 and 26 for absorbing the bending or buckling which occurs cyclically during the cutting operation. The contact material 32, conversely, lends the requisite abrasion resistance to the upper sides or tops of the pressure bars 25 and 26 so that cyclically occurring forces, acting angentially to the cutting knife tip 27, can be absorbed in the zone of contact of the material web 1 with the pressure bars 25 and 26. The pressure bars 25 and 26 according to the invention accordingly combine high elasticity with high abrasion resistance of the contact material 32 which fixes the material web 1 at the instant of time it is cut by the cutting tool. The cyclical alternating stressing of the material of the pressure bars 25 and 26, if only base material 29 were used, would lead to premature fatigue in the contact region or, in other words, on the upper sides or tops of the pressure bars 25 and 26.

As can also be ascertained from FIG. 3, the clamping surfaces 24 of the two vise halves 21.1 and 21.2 embrace the pressure bars 25 and 26. Each of the pressure bars 25 and 26, respectively, is formed with a respective chamfer 33 which faces the clamping surface 24 and on which the clamping surface 24 of the respective vise half 21.1, 21.2 rests. The pressure bars 25 and 26 are thus fixed between the clamping surfaces 24 of the respective vise halves 21.1 and 21.2, on the one hand, and the cutting knife 20, on the other hand. The contact material 32, that is provided in the upper region of the pressure bars 25 and 26, is located, with respect to the pressure bars 25 and 26, at the region of the pressure bars 25 and 26 that is not enclosed by the clamping faces 24, so that, at the instant of cutting, a defined or limited deformability of the base material 29 in the vise 21 is possible.

I claim:

1. In a device for cutting a web of material in a folder, the device having a cutting cylinder with a jacket and a cutting tool accommodated on the cutting cylinder, a cutting tool support comprising:

pressure bars flanking and directly engaging the cutting tool, and projecting resiliently beyond the jacket of the cutting cylinder, said pressure bars being formed of an elastic base material and a contact material having a greater hardness than that of said base material, said contact material of said pressure bars being in engagement with the web of material during the cutting of the web of material, said contact material being entirely outside the jacket.

2. The cutting tool support according to claim 1, wherein said pressure bars are embedded in a vise embracing said pressure bars.

3. The cutting tool support according to claim 2, wherein said vise includes two vise halves.

4. The cutting tool support according to claim 3, wherein said vise halves are formed with clamping surfaces between which the cutting tool is received.

5. The cutting tool support according to claim 2, wherein said vise has clamping surfaces for acting upon said pressure bars.

6. The cutting tool support according to claim 2, wherein said contact material is disposed in a region of said pressure bars that projects beyond said vise.

7. The cutting tool support according to claim 1, wherein said base material of said pressure bars has a Shore hardness between 30 and 35 Shore.

8. The cutting tool support according to claim 1, wherein said contact material has a Shore hardness greater than 85 Shore.

9. The cutting tool support according to claim 1, wherein the cutting tool has a tip and is formed with a taper in a region of said cutting tool tip.

10. The cutting tool support according to claim 9, wherein said pressure bars surround the cutting tool and are spaced from said tapered cutting tool tip, so that said tapered cutting tool tip does not engage the surrounding pressure bars.

11. The cutting tool support according to claim 1, wherein he cutting tool is a cutting knife.

12. In a folder, a combination comprising:

a cutting cylinder having a jacket and a cutting knife disposed thereon for cutting a material web; and pressure bars flanking and directly engaging said cutting knife and projecting resiliently beyond said jacket of said cutting cylinder, said pressure bars surrounding said cutting knife and being formed of an elastic base material and a contact material having a hardness greater than that of said elastic base material, said contact material being in engagement with the material web during the cutting thereof, said contact material being entirely outside the jacket.

13. A folder having a device for cutting a material web, comprising:

a cutting cylinder having a jacket, a cutting knife disposed on said cutting cylinder, said cutting knife having a bore formed therein, pressure bars flanking and directly engaging said cutting knife, said pressure bars projecting resiliently beyond said jacket of said cutting cylinder, said pressure bars surrounding said cutting knife and being formed of an elastic base material and a contact material, said contact material having a hardness greater than that of said elastic base material, said contact material being in engagement with the material web during the cutting thereof, said contact material being entirely outside the jacket.

* * * * *